US006991373B2

(12) United States Patent
Carr et al.

(10) Patent No.: US 6,991,373 B2
(45) Date of Patent: Jan. 31, 2006

(54) EMESIS WASTE DISPOSAL SYSTEM

(75) Inventors: Jodi Lynn Coval Carr, Seattle, WA (US); James Gerald Carr, Seattle, WA (US)

(73) Assignee: As We Grow LLC, Fort Myers, FL (US)

( * ) Notice: Subject to any disclaimer, the term of this patent is extended or adjusted under 35 U.S.C. 154(b) by 172 days.

(21) Appl. No.: 10/429,066

(22) Filed: May 2, 2003

(65) Prior Publication Data

US 2004/0001653 A1 Jan. 1, 2004

Related U.S. Application Data

(60) Provisional application No. 60/377,632, filed on May 3, 2002.

(51) Int. Cl.
*B65D 30/08* (2006.01)

(52) U.S. Cl. ..... 383/111; 383/2; 383/89; 220/495.11

(58) Field of Classification Search ..... 383/2, 383/111, 113, 33, 86, 89; 220/495.11
See application file for complete search history.

(56) References Cited

U.S. PATENT DOCUMENTS 2,880,775 A * 4/1959 Beattie ..... 383/111
3,548,906 A 12/1970 Murphy
3,920,179 A 11/1975 Hall
4,610,358 A * 9/1986 Walter ..... 206/514
4,679,242 A * 7/1987 Brockhaus ..... 383/4
4,917,238 A 4/1990 Schumacher
5,354,131 A * 10/1994 Mogil ..... 383/24
5,404,999 A 4/1995 Bednar
5,490,396 A * 2/1996 Morris ..... 62/457.2
5,647,670 A 7/1997 Iscovich
5,713,616 A 2/1998 Knudson
5,725,310 A 3/1998 Kruczko
5,927,800 A * 7/1999 Stallworth ..... 297/188.08
5,971,969 A 10/1999 Cashel
6,199,737 B1 3/2001 Ringelstetter
6,257,473 B1 7/2001 Ringelstetter
6,345,911 B1 2/2002 Young et al.

FOREIGN PATENT DOCUMENTS

CN 2520858 U 11/2002
DE WO98/43593 10/1998
TW 0403088 Y 8/2000

* cited by examiner

*Primary Examiner*—Jes F. Pascua
(74) *Attorney, Agent, or Firm*—Patrick M. Dwyer

(57) ABSTRACT

An emesis waste disposal system with both an outer bag and an inner bag. The inner bag is releasably attached within an inside of the outer bag, and disposed in a ready, open position within the outer bag. Advantageously an edge of the inner bag is folded out over a lip of the outer bag, to receive waste into the inner bag without soiling the outer bag. Optionally, the inner bag is releasably attached within an inside of the outer bag with a removable fastener such as a tin tie, hook and loop pile, or snap set.

20 Claims, 8 Drawing Sheets

EMESIS WASTE DISPOSAL SYSTEM

This application claims priority to U.S. Provisional Application 60/377,632 filed May 3, 2002.

TECHNICAL FIELD

The invention relates to portable waste disposal systems; more particularly, it relates to a portable emesis waste disposal system.

BACKGROUND OF THE INVENTION

There is a need for a portable container or system to hold large amounts of vomit and/or other bodily waste from those who get sick in public places. Such a waste bag system would also carry wipes and related clean up supplies and/or personal items in accessory zippered pockets in the pack or kit, and have the appearance of a wallet or small handbag so as not to draw added attention to the carrier of the bag.

Currently, paper bags with a plastic coating are used (typical air sickness bag). This is not enough for some; not enough in size for some users and no storage compartment to carry clean up items and/or personal items. Also, the appearance of this type of bag suggests that someone is, or expects soon to become, sick. It is distressing to use when sick, and distressing to other people to have to watch, or even contemplate.

Recycled plastic bags and food containers are used by some, but the contents are visible with plastic bags and some food containers and most bags are not leak proof. They do not offer storage to carry clean up supplies, and these containers also draw attention to the user.

All of these needs are particularly heightened for women in various stages of pregnancy, and who are experiencing frequent, sometimes unpredictable, nausea.

DISCLOSURE OF THE INVENTION

The disclosed waste bag system addresses the need for a portable container to hold large amounts of vomit and/or other bodily waste from those who get sick in public places. The waste bag system also holds wipes and related clean up supplies and/or personal items in accessory zippered pockets in the pack or kit, and has the appearance of a wallet or small handbag so as not to draw added attention to the carrier of the bag.

The user of this bag can get sick in public behind the bag's flap for some measure of privacy, and reach to the back pocket for items they packed for cleaning up the face. The back pocket can hold personal items making a wallet unnecessary for some users, and it can hold a package of tissue and a few extra items for clean up. The waste in the plastic leak proof opaque liner may then be conveniently, discretely and sanitarily disposed of. The plastic liner is detached from the bag by removing (unbending) the tin ties (flat plastic strips reinforced with malleable wire, one along each top side of the disposable liner bag) at the top of the plastic liner from the corners of the bag. The plastic liner top can then be rolled down and secured closed with the tin ties (the tin ties are strong enough that the user can grip the top of a plastic liner full of liquid while holding on to the tin ties and they will support the carrying of the plastic liner). The full plastic liner can then be disposed of immediately or carried in the bag with the flap snapped down to dispose of when convenient. When the full plastic liner is out of the bag, a new liner stored at the bottom of the bag can be attached to the bag and then the whole thing folded compact again until the bag is once more needed.

To these ends, an emesis waste disposal system with both an outer bag and an inner bag is disclosed. The outer bag/inner bag combination is preferably foldable and each bag made from some flexible material. The outer-inner bag combination is optionally releasably closable into a traveling package smaller in profile than either of the open bags. Advantageously, a releasable closure half set on an inside of the flap of the outer bag and a mating releasable closure half set on the lower outside of the back of the outer bag form two half sets engageable to releasably close the system, after folding, into the travel package shape.

The inner bag which is intended to be disposable is also flexible and foldable, but is disposed inside the outer bag in such a way that both bags are extended and open when the outer bag is open and extended. In preferred embodiments, the inner bag is releasably attached within an inside of the outer bag, and disposed in a ready, open position within the outer bag. By ready and open, is meant that when the outer bag opening is exposed after unfolding the bag, and the lip of the outer bag is pulled open, the opening of the inner bag is also open and ready to receive waste. It will be appreciated that it is neither necessary nor particularly desirable to remove the inner bag from the outer bag before depositing, or in order to deposit, waste into the inner bag.

Advantageously, the inner bag is somewhat larger in volume than the outer bag, and is somewhat longer from top to bottom, and an edge of the inner bag is folded out over the lip of the outer bag, so that waste is not easily admitted into the outer bag, that is, into the space between the inner and outer bags. Optionally, the releasable attachment of the inner bag to the inside of the outer bag is effected with a removable fastener such as one or more novelty disclosed tin ties, or such as conventional hook and loop pile sets, snap sets, or the like conventional removable fastener, now known or later developed, substitutions for which will readily occur to those skilled in the art.

In a preferred embodiment of the disclosed emesis waste disposal system, the removable fastener is a tin tie, a name used in the art in general to describe flat plastic strips reinforced with malleable wire. One tin tie is disposed along each top side of the disposable inner bag (or liner bag). A free or protruding end of the tin tie (the part not attached to the inner bag) is preferably threaded from inside the outer bag through an aperture in the outer bag below the lip of the outer bag, and then folded up and over a fold of the inner bag that is folded over the outer bag lip. In preferred embodiments, the removable fastener is integral to an outside of the inner bag, which typically means that the fastener is either attached to the upper sides of the inner bag, or actually manufactured as part of the inner bag. Advantageously, the removable fastener is also used to seal the inner bag after the inner bag is filled with waste.

BEST MODE OF CARRYING OUT THE INVENTION

Figure 1:
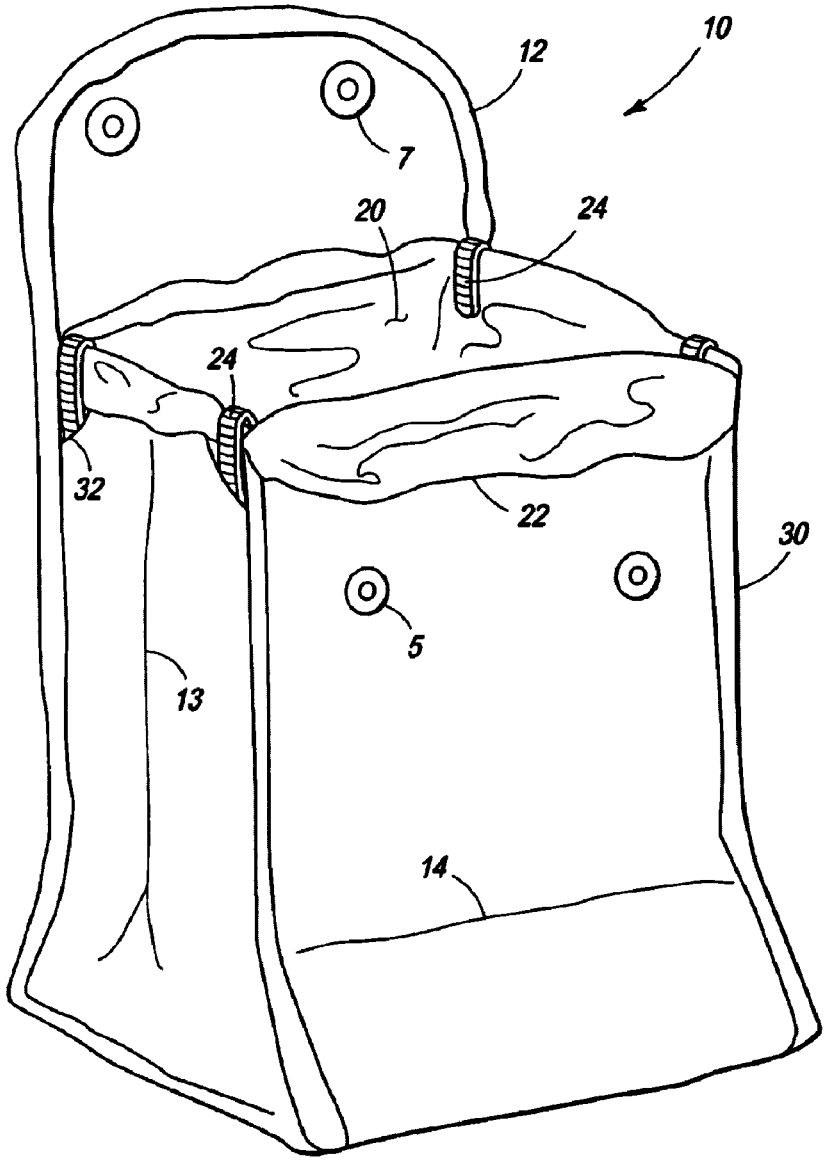
FIG. 1 is a perspective view of the double bag waste system.

The disclosed waste system is made with marine grade snaps which secure the flap of the outer bag closed so the weight of the full plastic liner bag will not cause the bag to open. The back zippered pocket uses reliable YKK zippers. The zipper secures even the smallest items to carry around. The outer bag also functions as a handbag, without the disposable plastic liners, when the original need for it no longer exists. The system is compact, folding to wallet size, when not in use. The bag can store additional plastic liner bags at the bottom of the inside of the outer bag for continued/next usage.

Preferred plastic liners are leak proof (advantageously, those bags specially designed to transport exotic fish are preferred and readily available at appropriate supply outlets) and they are also opaque so fluid and waste stays in the bag and the contents are not visible to the user or others.

The outer bag is preferably made of a durable vinyl cloth with a heavy banner vinyl lining, so the bag can get wet and/or cleaned often and keys won't poke through.

Turning now to the drawings, preferred embodiments will be described by reference to the numerals of the drawing figures wherein like numbers indicate like parts.

Figure 2:
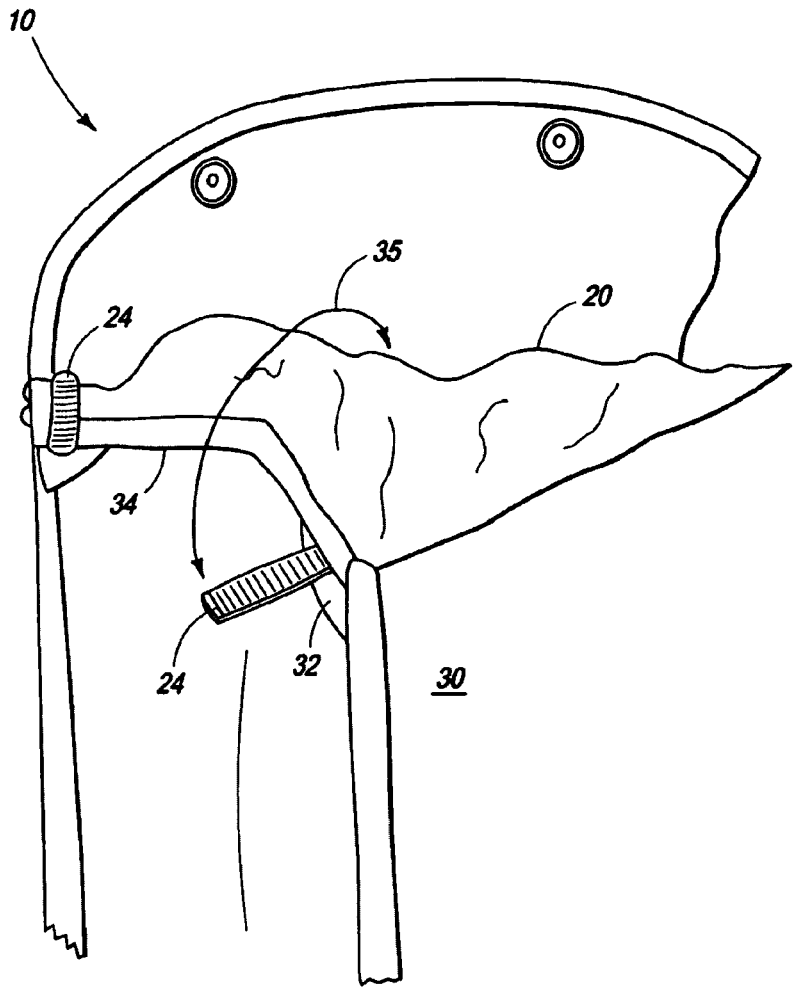
FIG. 2 is a detail schematic perspective of the releasable fastener attachment of inner bag to outer bag for the double bag waste system.
Figure 5:
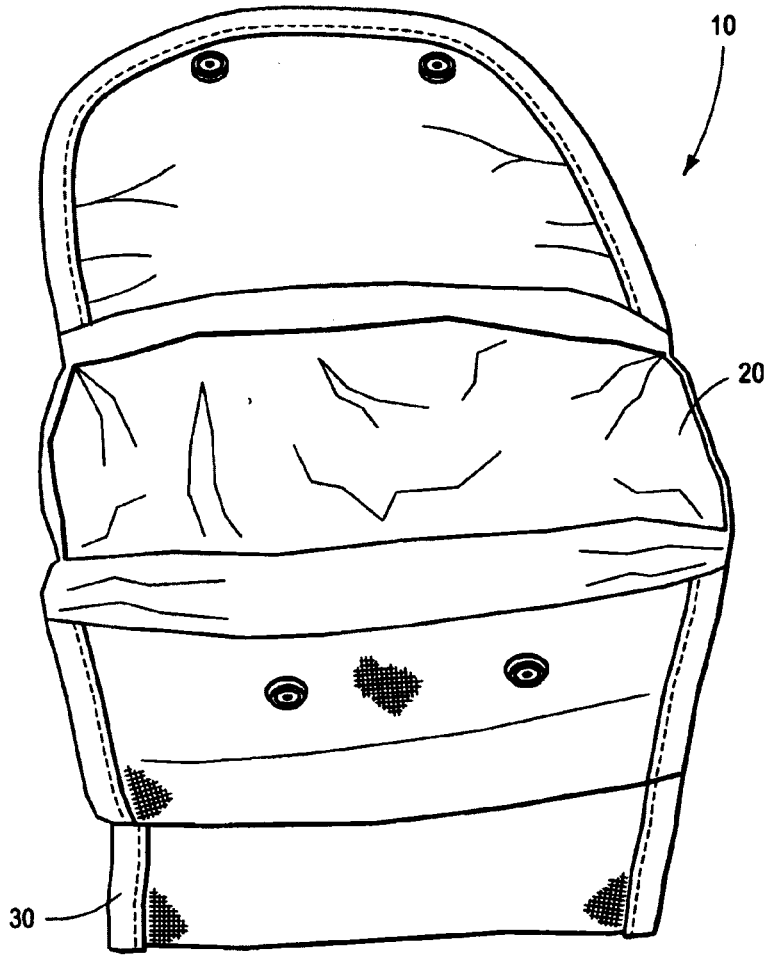
FIG. 5 is a photograph of the front of the unfolded waste bag system showing inner bag open and ready and attached with tin ties.
Figure 7:
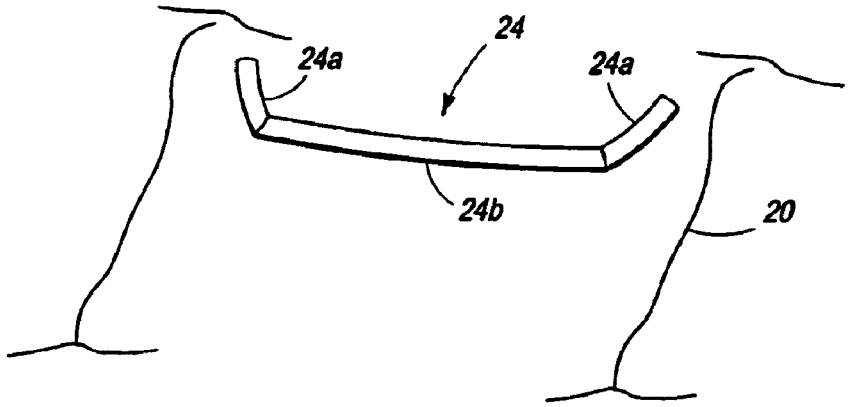
FIG. 7 is a detail schematic of the tin tie attachment to the inner bag.

FIG. 1 is a perspective view of the double bag waste system 10. FIG. 2 is a detail schematic perspective of the releasable fastener 24 attachment of inner bag 20 to outer bag 30 for the double bag waste system 10 using a preferred tin tie releasable fastener 24 that is integral to inner bag 20 in a preferred embodiment. See also FIG. 5, showing inner bag 20 open and ready and attached to outer bag 30 with tin ties 24. FIG. 7 is a detail schematic of the tin tie attachment to inner bag 20 showing tin tie 24 attached to inner bag 20 via electronic weld along tin tie bag attachment zone 24*b*, leaving two free tin tie ends 24*a* for engagement with outer bag 30 via apertures 32 just below outer bag lip 34 (FIG. 2). Preferred tin ties 24 are located about 1" to 1½" below the top of bag 20 on both front and back sides of the opening of bag 20, such that preferred tin tie bag attachment zone 24*b* for each tie or strip is about ¾" shorter than the bag's width on each side, and so that about 1" to 1¼" of each tin tie on each end is free to bend, and is not welded, or otherwise attached, to bag 20.

In FIG. 2, tin tie end 24 (24*a* in FIG. 7) is threaded from the inside of outer bag 30 outwardly through aperture 32 just below outer bag lip 34. The top of inner bag 20 is then preferably folded down over lip 34 (to position shown in FIG. 1 as top fold 22) and captured in the grasp of folded tin tie 24 as it is folded upward and inward into the top of inner bag 20 (in the direction shown by arrow 35). This releasable engagement is followed for each of four preferred tin ties per inner bag. Release of inner bag 20 from engagement with outer bag 30 is effected by unbending ties 24 and then reverse threading them back through apertures 32.

Returning to FIG. 1, flap 12 effects "full" closure of outer bag 30, preferably only when inner bag 20 is full and sealed and disposed for transport and disposal down inside bag 30, by folding flap 12 down over bag 30 opening so that flap snaps 7 engage front snaps 5. When the bag system is not full, but empty, it is foldable into a much smaller shape (see FIGS. 3 and 4) with the aid of horizontal fold zone 14 and vertical fold zone 13, in nature and effect much like the folds of a paper grocery bag.

Figure 3:
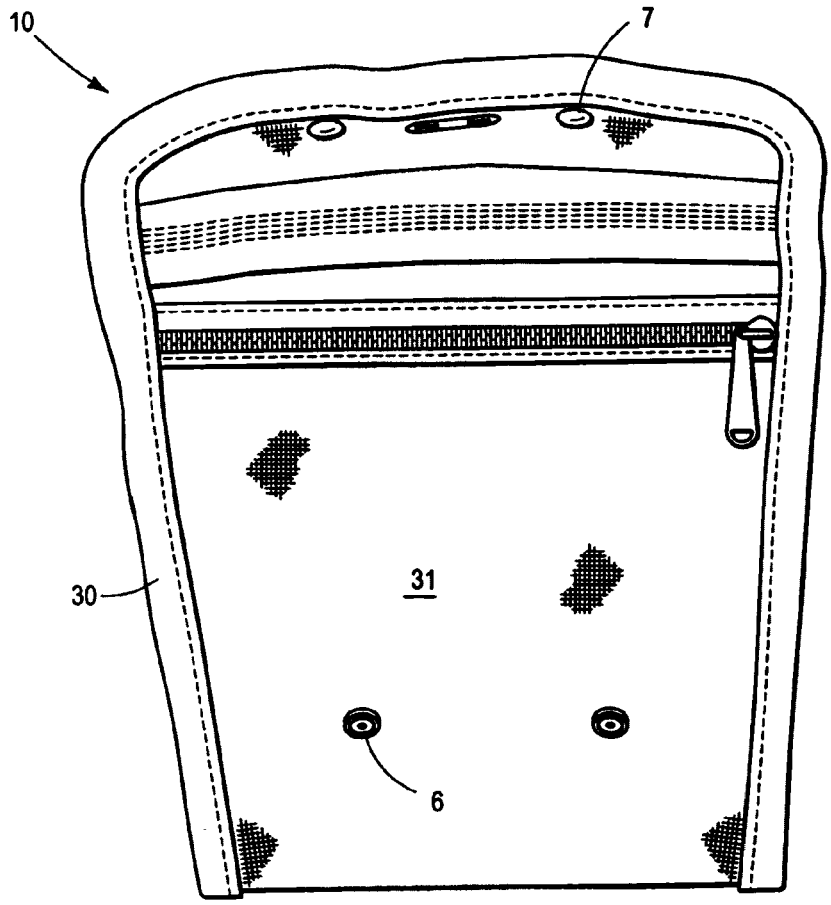
FIG. 3 is a photograph of the back side of the unfolded waste bag system.
Figure 4:
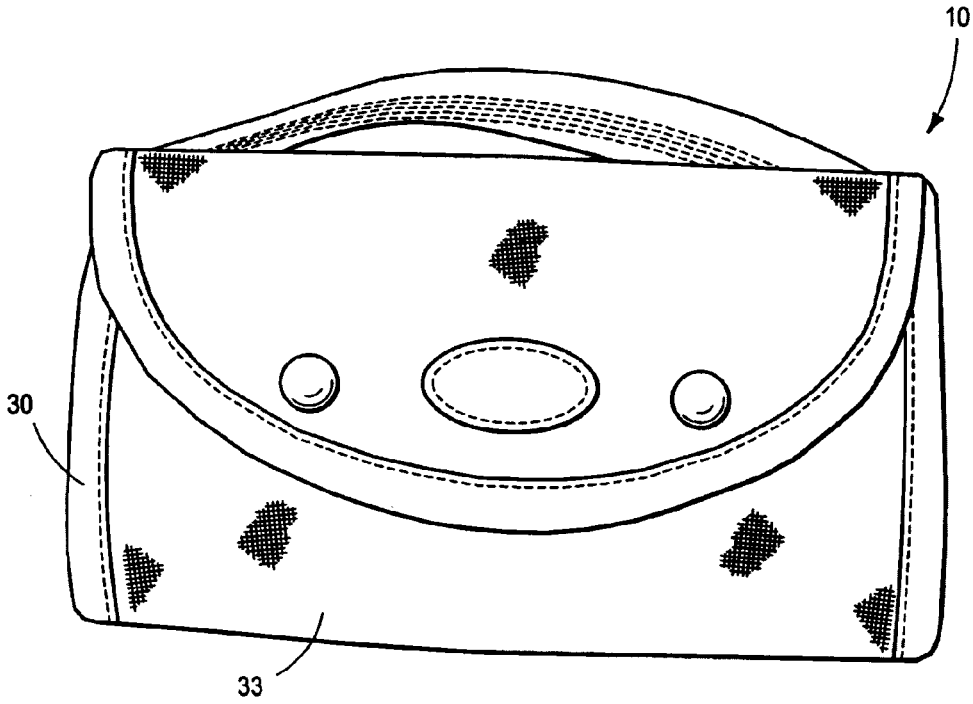
FIG. 4 is a photograph of the front side of the folded waste bag system.
Figure 6:
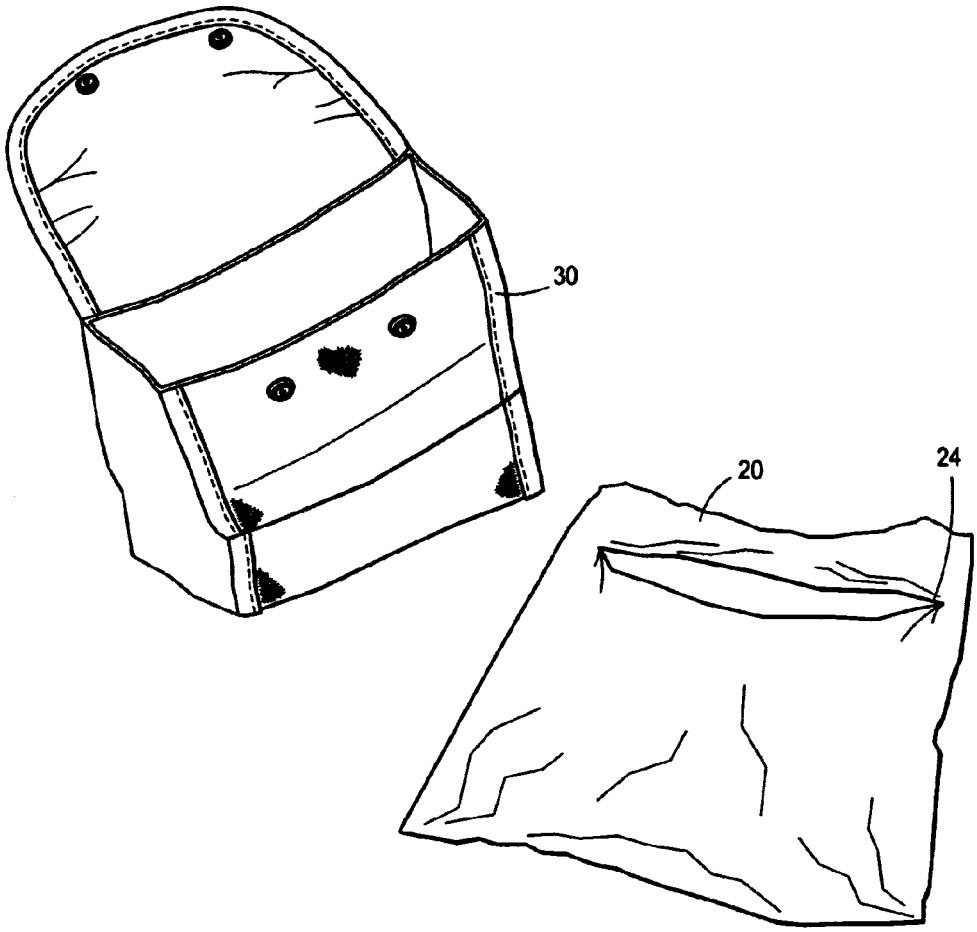
FIG. 6 is a photograph of the unfolded and open outer bag with inner bag removed.

FIGS. 3, 4 and 6 are photographs of the back side (FIG. 3) of the unfolded waste bag system, with back snaps 6 and flap snaps 7, the engagement of which in conjunction with the foldability of waste bag system 10, results in the view shown as the front side of the folded waste bag system (FIG. 4) (as the bottom of bag 30 is folded upwardly onto the front of bag 30, covering front snaps 5, but presenting back snaps 6 for engagement with flap snaps 5), and the unfolded and open outer bag with inner bag removed (FIG. 6).

Figure 8A:
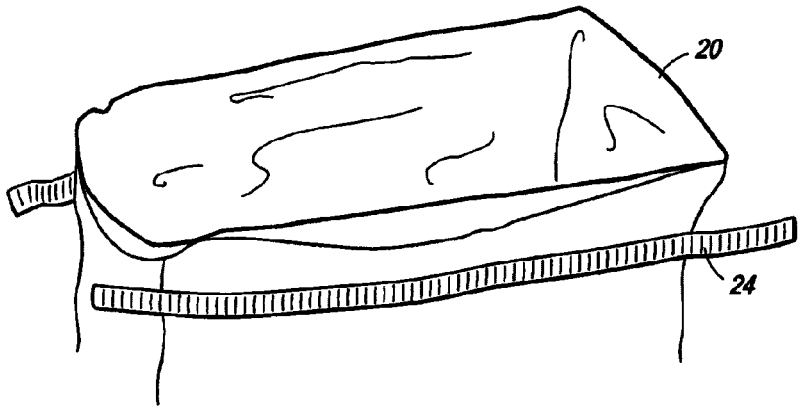
FIGS. 8*a*–8*c* is a detail schematic of the inner bag folded and locked closed with tin ties.
Figure 8B:
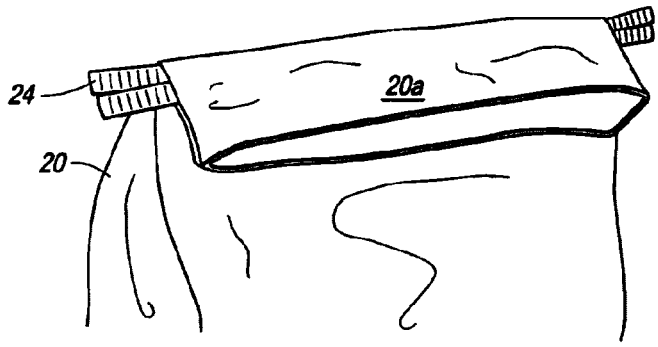
Figure 8C:
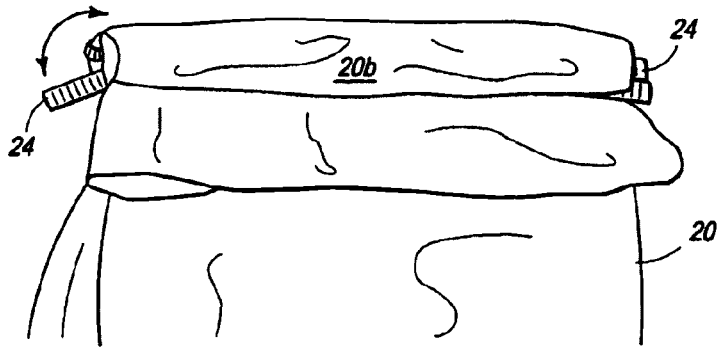

FIG. 8 is a detail schematic of inner bag 20 folded (20*a*) and locked closed (20*b*) with tin ties 24. In FIG. 8*a*, inner bag 20 is open and tin ties 24 are extended and released from their engagement with outer bag 30 (not shown—see FIG. 2 for engagement). In FIG. 8*b*, a first fold 20*a* is made to fold the portion of bag 20 that lies above the tin ties downwardly onto the body of bag 20. In FIG. 8*c*, a second fold 20*b* (and optional plurality of folds) is further made, and tin ties 24 are bent into locking engagement with fold 20*b* to seal bag 20 and prevent any fluid leakage during storage and eventual disposal.

Figure 9:
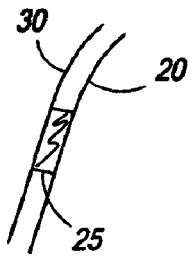
FIG. 9 is a schematic of an alternate hook and loop pile fastener.
Figure 10:
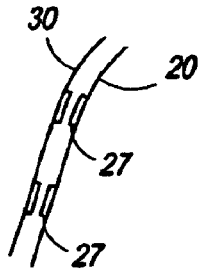
FIG. 10 is a schematic of an alternate snap set fastener.

FIG. 9 is a schematic of an alternate hook and loop pile fastener 25, and FIG. 10 is a schematic of an alternate snap set fastener 27. Either or both, or combinations of the two, or combinations of the two with tin ties, or material substitutions for conventional snaps 27 and/or conventional hook and loop pile 25 that will occur to those skilled in the art, maybe used to effect the releasable attachment of inner bag 20 to outer bag 30.

In compliance with the statute, the invention has been described in language more or less specific as to structural features. It is to be understood, however, that the invention is not limited to the specific features shown, since the means and construction shown comprise preferred forms of putting the invention into effect. The invention is, therefore, claimed in any of its forms or modifications within the legitimate and valid scope of the appended claims, appropriately interpreted in accordance with the doctrine of equivalents.

We claim:

1. An emesis waste disposal system comprising an outer bag to receive an inner bag and an inner bag disposed and open within the outer bag to receive waste into the inner bag, while the inner bag is so disposed, without soiling the outer bag, and further wherein:

the inner and outer bags are comprised of a flexible material;

the inner bag is releasably attached within an inside of the outer bag with a removable fastener;

the removable fastener is a tin tie, and a free end of the tin tie is threaded from inside the outer bag through an aperture in the outer bag below an outer bag lip.

2. The emesis waste disposal system of claim 1, wherein the outer-inner bag combination is foldable, and releasably closable, into a traveling package smaller in profile than either of the open bags.

3. The emesis waste disposal system of claim 2, further comprising a releasable closure half set on an inside of a flap of the outer bag and a releasable closure half set on a lower outside of a back of the outer bag, the two half sets engageable to releasably close the system into the travel package.

4. The emesis waste disposal system of claim 1, wherein the inner bag is attached such that opening the outer bag opens the inner bag.

5. The emesis waste disposal system of claim 4, wherein an edge of the inner bag is folded out over a lip of the outer bag.

6. The emesis waste disposal system of claim 1, wherein the free end of the tin tie is then folded up and over a fold of the inner bag that is folded over the outer bag lip.

7. The emesis waste disposal system of claim 1, wherein the inner bag is disposed such that opening the outer bag opens the inner bag, and an edge of the inner bag is folded out over a lip of the outer bag.

8. An emesis waste disposal system comprising an outer bag to receive an inner bag and an inner bag disposed and open within the outer bag to receive waste into the inner bag, while the inner bag is so disposed, without soiling the outer bag and further wherein:

the inner and outer bags are comprised of a flexible material;

the inner bag is releasably attached within an inside of the outer bag with a removable fastener selected from the group consisting of a tin tie, a hook and loop pile pairing, and a snap set;

the removable fastener is integral to an outside of the inner bag; and the removable fastener comprises additional fastener half sets positioned on the inner bag such that when the inner bag is folded, 2 or more fastener half sets are connectable to seal the inner bag.

9. An emesis waste disposal system comprising an outer bag and an inner bag releasably attached within an inside of the outer bag, and disposed and open within the outer bag to receive waste into the inner bag without soiling the outer bag, and further wherein:

the inner and outer bags are comprised of a flexible material;

the inner bag is releasably attached within an inside of the outer bag with a removable tin tie fastener; and a free end of the tin tie is threaded from inside the outer bag through an aperture in the outer bag below an outer bag lip.

10. The emesis waste disposal system of claim 9, wherein the inner bag is attached such that opening the outer bag opens the inner bag.

11. The emesis waste disposal system of claim 10, wherein an edge of the inner bag is folded out over a lip of the outer bag.

12. The emesis waste disposal system of claim 9, wherein the free end of the tin tie is then folded up and over a fold of the inner bag that is folded over the outer bag lip.

13. The emesis waste disposal system of claim 9, wherein the tin tie fastener is also used to seal the inner bag when the inner bag is filled with waste by wrapping the bendable tin tie around an opening of the inner bag after it is released and removed from the outer bag.

14. The emesis waste disposal system of claim 13, wherein an edge of the inner bag is folded out over a lip of the outer bag.

15. An emesis waste disposal system comprising an outer bag and an inner bag releasably attached within an inside of the outer bag, the inner bag attached such that opening the outer bag opens the inner bag to receive waste into the inner bag; and further wherein:

the inner and outer bags are comprised of a flexible material;

the inner bag is releasably attached within an inside of the outer bag with a removable tin tie fastener; and a free end of the tin tie is threaded from inside the outer bag through an aperture in the outer bag below an outer bag lip.

16. The emesis waste disposal system of claim 15, wherein the free end of the tin tie is then folded up and over a fold of the inner bag that is folded over the outer bag lip.

17. The emesis waste disposal system of claim 15, wherein the tin tie fastener is also used to seal the inner bag when the inner bag is filled with waste by wrapping the bendable tin tie around an opening of the inner bag after it is released and removed from the outer bag.

18. An emesis waste disposal system comprising an outer bag and an inner bag releasably attached within an inside of the outer bag, the inner bag disposed such that opening the outer bag opens the inner bag, with an edge of the inner bag folded out over a lip of the outer bag to receive waste into the inner bag without soiling the outer bag, and further wherein:

the inner and outer bags are comprised of a flexible material;

the inner bag is releasably attached within an inside of the outer bag with a removable fastener selected from the group consisting of a tin tie, a hook and loop pile pairing and a snap set;

the removable fastener is integral to an outside of the inner bag; and the removable fastener comprises additional fastener half sets positioned on the inner bag such that when the inner bag is folded, 2 or more fastener half sets are connectable to seal the inner bag when the inner bag is filled with waste.

19. An emesis waste disposal system comprising an outer bag and an inner bag releasably attached within an inside of the outer bag with a removable fastener selected from the group consisting of a tin tie, a hook and loop pile pairing and a snap set, and disposed and open within the outer bag to receive waste into the inner bag, and further wherein:

the inner and outer bags are comprised of a flexible material;

the removable fastener is integral to an outside of the inner bag; and the removable fastener comprises additional fastener half sets positioned on the inner bag such that when the inner bag is folded, 2 or more fastener half sets are connectable to seal the inner bag when the inner bag is filled with waste.

20. The emesis waste disposal system of claim 19, wherein the inner bag is disposed such that opening the outer bag opens the inner bag, and an edge of the inner bag is folded out over a lip of the outer bag.

* * * * *